US010907281B2

(12) United States Patent
Koeckritz

(10) Patent No.: US 10,907,281 B2
(45) Date of Patent: Feb. 2, 2021

(54) FABRIC TAPE FOR PRODUCING WEB MATERIAL, IN PARTICULAR FOR PRODUCING SPUNBONDED FABRIC

(71) Applicant: VOITH PATENT GMBH, Heidenheim (DE)

(72) Inventor: Uwe Koeckritz, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 705 days.

(21) Appl. No.: 15/547,169

(22) PCT Filed: Jan. 27, 2016

(86) PCT No.: PCT/EP2016/051644
§ 371 (c)(1),
(2) Date: Jul. 28, 2017

(87) PCT Pub. No.: WO2016/120300
PCT Pub. Date: Aug. 4, 2016

(65) Prior Publication Data

US 2018/0010267 A1 Jan. 11, 2018

(30) Foreign Application Priority Data

Jan. 28, 2015 (DE) ..... 10 2015 201 428

(51) Int. Cl.
*D03D 1/00* (2006.01)
*D04H 3/02* (2006.01)
(Continued)

(52) U.S. Cl.
CPC ..... *D03D 1/0094* (2013.01); *D03D 15/0005* (2013.01); *D03D 15/0027* (2013.01);
(Continued)

(58) Field of Classification Search
CPC ..... D03D 1/0094; D03D 15/0027; D13D 15/005; D04H 3/02; D04G 3/16; D04G 3/14
See application file for complete search history.

(56) References Cited

U.S. PATENT DOCUMENTS 3,438,587 A * 4/1969 Jackson, Jr. ..... B65H 54/06 156/167
4,359,501 A * 11/1982 DiTullio ..... D01F 6/665 139/383 A
(Continued)

FOREIGN PATENT DOCUMENTS

EP 1726697 A1 11/2006
EP 1751348 A1 2/2007
(Continued)

*Primary Examiner* — Clinton T Ostrup
*Assistant Examiner* — Andrew Wayne Sutton
(74) *Attorney, Agent, or Firm* — Laurence A. Greenberg; Werner H. Stemer; Ralph E. Locher

(57) ABSTRACT

A fabric belt on which, when used as intended in a machine for producing spunbonded fabric webs, such spunbonded fabric webs are formed and transported. The belt has longitudinal threads and transverse threads that bind with the longitudinal threads. The threads are formed substantially of a polymer material and some of the longitudinal and/or transverse threads include electrically conductive material. The longitudinal threads form, on the web material contact side, convex longitudinal thread offsets with a knuckle, and the transverse threads have first transverse threads which form, on the web material contact side, first transverse thread offsets with a knuckle. A height difference between the knuckle crowns of at least some of the convex longitudinal thread offsets and the knuckle crowns of at least some of the first convex transverse thread offsets on the web material contact side is less than 220 μm or even less than 150 μm.

20 Claims, 2 Drawing Sheets

(51) Int. Cl.

| | |
|---|---|
| ***D04H 3/14*** | (2012.01) |
| ***D04H 3/16*** | (2006.01) |
| ***D03D 15/00*** | (2006.01) |
| ***D21J 1/08*** | (2006.01) |

(52) U.S. Cl.
CPC ..... *D04H 3/02* (2013.01); *D04H 3/14* (2013.01); *D04H 3/16* (2013.01); *D21J 1/08* (2013.01); *D10B 2101/122* (2013.01)

(56) References Cited

U.S. PATENT DOCUMENTS

| | | | | |
|---|---|---|---|---|
| 4,636,426 | A | 1/1987 | Fleischer | |
| 5,746,887 | A | 5/1998 | Wendt et al. | |
| 6,465,074 | B1 * | 10/2002 | FitzPatrick ..... | D03D 1/0094 162/358.4 |
| 8,444,825 | B2 | 5/2013 | Pitzler et al. | |
| 2003/0068948 | A1 | 4/2003 | Smith et al. | |
| 2004/0198118 | A1 | 10/2004 | Levine et al. | |
| 2011/0121481 | A1 | 5/2011 | Monnerie et al. | |
| 2018/0010267 | A1 * | 1/2018 | Koeckritz ..... | D04H 3/02 |

FOREIGN PATENT DOCUMENTS

| | | | |
|---|---|---|---|
| EP | 1448820 | B1 | 8/2009 |
| JE | 102006003910 | A1 | 8/2006 |
| JP | 2004027407 | A | 1/2004 |
| WO | 2012047511 | A1 | 4/2012 |

* cited by examiner

FABRIC TAPE FOR PRODUCING WEB MATERIAL, IN PARTICULAR FOR PRODUCING SPUNBONDED FABRIC

BACKGROUND

Field of the Invention

The present invention relates to a belt for production of web material, for example spunbonded web.

EP 1 448 820 B1 discloses a machine for production of spunbonded webs that, by way of a forming and transporting belt, displays a woven-fabric belt having what is called there a "4B weave" design.

Such woven-fabric belts oftentimes, especially for use as forming and transporting belts of spunbonded webs, have very large differences in height between the parts of the web material contact side which are provided by knuckles of the longitudinal threads and by knuckles of the transverse threads. Experience with such woven-fabric belts shows that the spunbonded webs formed, and subsequently transported, thereon, which generally have very low basis weights per ply of below 20 grams/$m^2$, cannot be reliably transported at the machine speeds oftentimes used in such processes, of up to 1100 meters per minute, for example owing to turbulent air. When, to stabilize the transportation of the spunbonded webs, the vacuum level is raised, these spunbonded webs are oftentimes pulled into the woven structure, making them often very difficult to remove again from the woven-fabric belts in a subsequent transfer process.

SUMMARY OF THE INVENTION

The problem addressed by the present invention is therefore that of providing, for use as forming and transporting belt in a machine for production of spunbonded webs, a woven-fabric belt that offers an improved level of initial support for fiber, so a spunbonded web is more reliable to transport thereon and also easier to remove again therefrom.

The problem is solved according to the present invention by a woven-fabric belt whereon, when put to its intended use in a machine for production of spunbonded webs, such spunbonded webs are formed and transported, comprising a plurality of longitudinal threads, running substantially in a longitudinal belt direction, and a plurality of transverse threads, running substantially in a transverse belt direction and interlacing with the longitudinal threads, wherein the longitudinal and transverse threads are constructed substantially of a polymer material and a portion of the longitudinal and/or transverse threads comprises electrically conducting material, wherein longitudinal threads form, on the web material contact side, convex longitudinal thread knuckles each having a crown and also the transverse threads include first transverse threads and the first transverse threads form, on the web material contact side, convex first transverse thread knuckles each having a crown.

The woven-fabric belt of the present invention further provides that the height difference between the crowns of at least some, specifically the convex longitudinal thread knuckles and the crowns of at least some, specifically the first convex transverse thread knuckles on the web material contact side is less than 220 μm, preferably less than 180 μm, more preferably less than 150 μm.

As a result of the height difference between the crowns of convex longitudinal thread knuckles and the crowns of first transverse thread knuckles on the web material contact side being less than 220 μm, preferably less than 180 μm, more preferably less than 150 μm, the spinbonding filaments at their point of laydown onto the web material contact side of the woven-fabric belt enjoy very uniform support in terms of height and therefore do not dip as deeply into the woven-fabric structure as is the case with the woven-fabric belts known from the prior art. In consequence, the spunbonded web formed from the spinbonding filaments experiences a high area of contact coupled with lower immersion of the spinbonding filaments into the woven-fabric structure. The effect achieved as a result thereof is superior adherence of the spunbonded web to the woven-fabric belt without the spunbonded web being pulled into the interior of the woven-fabric belt.

This provides a distinctly improved level of transportation behavior, coupled with a distinctly improved detach and release behavior of the spunbonded webs off from the woven-fabric belt.

A further achievement by virtue of this woven-fabric structure is that soiling, for example in the form of polymer droplets which may fall from the filament extrusion dies onto the woven-fabric belt, do not fall so deeply into the woven-fabric structure. As a result, the woven-fabric belts of the present invention soil less and are easier to clean.

The height difference between the crowns of the convex longitudinal thread knuckles and those of the first transverse thread knuckles is determined in a sectional plane extending perpendicularly to the web material contact side. The method of x-ray micro computed tomography, also known as micro-CT, is an example of a useful method of measurement. To carry out a measurement, a 10 millimeter diameter sample of the woven-fabric belt to be measured is sandwiched flat between two Plexiglas plates and exposed to a pressure of 0.1 MPa in a pressure chamber. The measurement was carried out using a resolution of 8 micrometers.

The term "crown of the convex thread knuckle" is to be understood as meaning the highest point on the web material contact side of the thread knuckle considered.

Regarding the effect of incorporating electrically conducting longitudinal and/or transverse threads in the woven-fabric belt: it creates the possibility of also using said belt in production processes which, unlike the papermaking process, proceed in a dry manner and thus are subject to the potential risk of electrostatic charges building up. Such an electrostatic charge buildup is avoided in the papermaking process by the process taking place in the presence of a large amount of water to be removed from the raw material used for paper fabrication and thus there is in principle no risk of an electrostatic charge buildup. Especially the spunbonded web production process does not utilize liquid vehicles, so the constant rolling of the woven-fabric belt on the rolls driving and guiding said belt and also the contact and/or relative movement between the spunbonded web to be fabricated and the woven-fabric belt may give rise to electrostatic charges building up. The provision of electrically conducting transverse threads makes it possible for the woven-fabric belt, for example in a lateral edge region, to be electrically contacted, and set to ground potential, by a sliding contact or the like.

It must be noted that, when the woven-fabric belt of the present invention is put to its intended use, its longitudinal belt direction coincides with each of the transportation direction, the belt movement direction and the machine direction. So the terms "transportation direction", "belt movement direction" and "machine direction" are herein to be understood as interchangeable.

Advantageous embodiments and refinements of the invention are disclosed in the dependent claims.

Specifically, the solution of the present invention is realizable by virtue, for example, of conditions for selecting the polymer material of the longitudinal threads and that of the first transverse threads and for heat-setting the woven-fabric belt having been such that the first transverse threads were more deformed from their state before the heat-setting than the longitudinal threads were deformed from their state before the heat-setting. In heat-setting here, the longitudinal threads were exposed to a tensile stress whilst the longitudinal and transverse threads are subjected to the effect of a temperature not less than 150° C., preferably in the range from 180 to 200° C.

Further specifically, the polymer material of the first transverse threads may be constructed using a two-phase polymer material, wherein a first polymer material phase of the two-phase polymer material has a higher melting temperature than a second polymer material phase of a two-phase polymer material, and wherein the longitudinal threads are constructed using a polymer material, especially using a one-phase polymer material, and the polymer material of the longitudinal threads has a melting temperature above the melting temperature of the second polymer material phase.

This embodiment may also be regarded as a further independent aspect of the invention. According to this independent aspect of the invention there is protected a woven-fabric belt for production of web material, especially for use in a machine for the production of spunbonded webs, which comprises a plurality of longitudinal threads running substantially in a longitudinal belt direction and a plurality of transverse threads running substantially in a transverse belt direction and interlacing with the longitudinal threads, wherein at least a portion of the transverse threads is constructed using electrically conducting material, wherein at least a portion of the transverse threads is constructed using two-phase polymer material, wherein a first polymer material phase of the two-phase polymer material has a higher melting temperature than a second polymer material phase of the two-phase polymer material, and wherein the longitudinal threads are constructed using polymer material and the polymer material of the longitudinal threads has a melting temperature above the melting temperature of the second polymer material phase.

In order to be able to endow even the woven-fabric belt which is suitable for the spunbonded web production process in particular with a stable woven-fabric structure, stable in a longitudinal belt direction in particular, the proposal is that the woven-fabric belt be heat-set, and that the melting temperature of the first polymer material phase of the two-phase polymer material of the first transverse threads and the melting temperature of the polymer material of the longitudinal threads be above a maximum heat-setting temperature and the melting temperature of the second polymer material phase of the two-phase polymer material of the first transverse threads be not higher than the maximum heat-setting temperature.

Advantageously, the melting temperature of the second polymer material phase is not less than 30° C. below the melting temperature of the first polymer material phase or/and below the melting temperature of the polymer material of the longitudinal threads. This is a sufficiently large gap to establish the heat-setting temperature with sufficient accuracy between these different melting temperatures.

The first polymer material phase may comprise polyethylene terephthalate (PET) material. Further, the second polymer phase material may comprise polyethylene (PE) material.

As an alternative to the two-phase polymer material, the polymer material of the first transverse threads may be constructed using a single-phase polymer material which, for example, comprises polypropylene (PP), polyethylene (PE) or thermoplastic polyurethane (TPU).

The two-phase polymer material may comprise the second polymer material phase at 1-10 wt %, preferably 2-6 wt %, as well as the first polymer material phase at 90-99 wt %, preferably 98-94 wt %.

When the polymer material of the longitudinal threads is a single-phase polymer material, the latter may preferably comprise polyethylene terephthalate (PET).

The electrically conducting longitudinal and/or transverse threads may further be constructed using polymer material, in which case the polymer material of the electrically conducting longitudinal and/or transverse threads more particularly contains electrically conducting particles, preferably carbon nanotubes.

The electrically conducting transverse threads may be configured as second transverse threads constructed using a polymer material other than that for the first transverse threads. It is conceivable in this connection that the second transverse threads are constructed of a single-phase polymer material for example. It is further conceivable that the second transverse threads have a smaller cross-sectional area than the first transverse threads. In addition, the cross-sectional area of the second transverse threads may even be smaller than that of the longitudinal threads. The single-phase polymer material of the electrically conducting transverse threads may comprise polyamide (PA) for example.

In general, the woven-fabric belt when put to its intended use in the machine for production of spunbonded web is exposed to an operating temperature above room temperature. A particularly preferred embodiment of the invention provides that the polymer material of the first transverse threads is selected such that it softens at the operating temperature such that the adherence of the spunbonded web to the first transverse threads is increased over its adherence to the first transverse threads at room temperature. This measure further increases the adherence of the spunbonded web to the woven-fabric belt and thereby makes the transportation of the spunbonded web on the woven-fabric belt distinctly more reliable.

The operating temperature may be in the range from 35° C. to 90° C., especially 45° C. to 70° C.

When the polymer material of the first transverse threads is the two-phase polymer material, a specific preferred embodiment of the aforementioned refinement of the invention provides in particular that the proportion of first to second polymer material phase of the two-phase polymer material is selected such that the first transverse threads constructed of the two-phase polymer material have softened at the operating temperature such that the adherence of the spunbonded web thereto is increased over the adherence at room temperature.

Since the transverse threads extend lengthwise at right angles to the transportation/machine direction of the woven-fabric belt, a considerable proportion to which the spunbonded web is entrained by the woven-fabric belt is due to the transverse threads, especially the first transverse threads. To enhance this effect, a particularly sensible embodiment provides that, at the operating temperature, the material of the first transverse threads softens more than the material of the longitudinal threads, so at the operating temperature the adherence of the spunbonded web to the first transverse threads is increased over the adherence of the spunbonded web to the longitudinal threads.

In the woven-fabric belt of the present invention, the longitudinal threads are advantageously warp threads and the transverse threads are advantageously weft threads.

The void volume described hereinafter may be determined via the micro-CT method described above.

A further preferred embodiment of the invention provides that the void volume accessible from the web material contact side is less than 0.45 $mm^3/mm^2$, preferably 0.40 $mm^3/mm^2$ or less. Applicant tests show that this measure further improves the support of the spunbonded filaments and thus the transportation behavior of the spunbonded web on the woven-fabric belt. By void volume accessible from the web material contact side is meant the void volume that is accessible from the web material contact side in a perpendicular projection.

Since it is known from experience that the enclosed void volume, i.e., the void volume not accessible in perpendicular projection either from the web material contact side or from the machine contact side, has an increased tendency to collect impurities and these can only be got back out with very great difficulty, if at all, a further preferred embodiment of the invention provides that the enclosed void volume is less than 0.65 $mm^3/mm^2$, preferably less than 0.60 $mm^3/mm^2$.

To nullify or reduce the degree to which the spunbonded web carried on the web material contact side is pulled into the interior of the woven-fabric structure of the woven-fabric belt by a vacuum applied to the machine contact side, a further preferred embodiment of the present invention provides that there is no void volume directly connecting the web material contact side to the machine contact side. Direct connection is to be understood as meaning that there are no passageways interconnecting the web material contact side to the machine contact side in perpendicular projection.

The present invention further provides a method of producing a spunbonded web using the woven-fabric belt of the present invention, which method comprises the step of applying spinbonding filaments to a web material contact side of the woven-fabric belt, moving in a belt movement direction, in at least one spinbonding filament application region, preferably a plurality of successive, in the belt movement direction, spinbonding filament application regions, wherein every spinbonding filament application region serves to lay a spunbonded ply down on the woven-fabric belt.

The method of producing a spunbonded web differs from a method for producing a fibrous web such as paper, board or tissue in that, for example, the latter involves a suspension of fibers and water being applied to the woven-fabric belt, whereas the spunbonded web production method is carried out in a dry manner, i.e., the filaments are laid down on the woven-fabric belt without a liquid as vehicle, for example water.

It is conceivable that every spinbonding filament application region comprises a multiplicity of successive, in the belt transverse direction, of spinbonding filament extrusion dies for delivery of spinbonding filaments onto the web material contact side of the woven-fabric belt.

In order to prevent electrostatic charges building up in the production process of spunbonded webs in relation to the woven-fabric belt, constructed in principle to have an electrically conducting property, it is further proposed that the woven-fabric belt moving in the belt movement or transportation direction be electrically contacted at one side edge region at least.

Preferably, each spunbonded ply has a basis weight of less than 15 grams per $m^2$, preferably less than 10 grams per $m^2$, especially a basis weight in the range from 1 to 15 grams per $m^2$, preferably from 1 to 10 grams per $m^2$, more preferably from 3 to 8 grams per $m^2$.

A spunbonded web generally has from one to ten and oftentimes from one to seven spunbonded plies.

It is further provided that the woven-fabric belt is maintained, at least in the spinbonding filament application region, at an operating temperature above room temperature, preferably at an operating temperature in the region of 35° C. or up to 90° C., more preferably in the range from 45° C. to 70° C.

In the process, the woven-fabric belt moves in the belt movement direction preferably at a speed of 300 meters per minute or more, more preferably at 350 to 1100 meters per minute, yet more preferably 600 to 1100 meters per minute. Providing the woven-fabric belt of the present invention ensures reliable transportation of the spunbonded web up to the high speeds of the stated range.

The spunbonded web filaments may be constructed substantially of polypropylene (PP) or of polyethylene (PE) or with a polypropylene core and a surrounding sheath of polyethylene (PE).

BRIEF DESCRIPTION OF SEVERAL VIEWS OF THE DRAWING

The present invention will now be further described with reference to the figures which follow, where.

DESCRIPTION OF THE INVENTION

Figure 1:
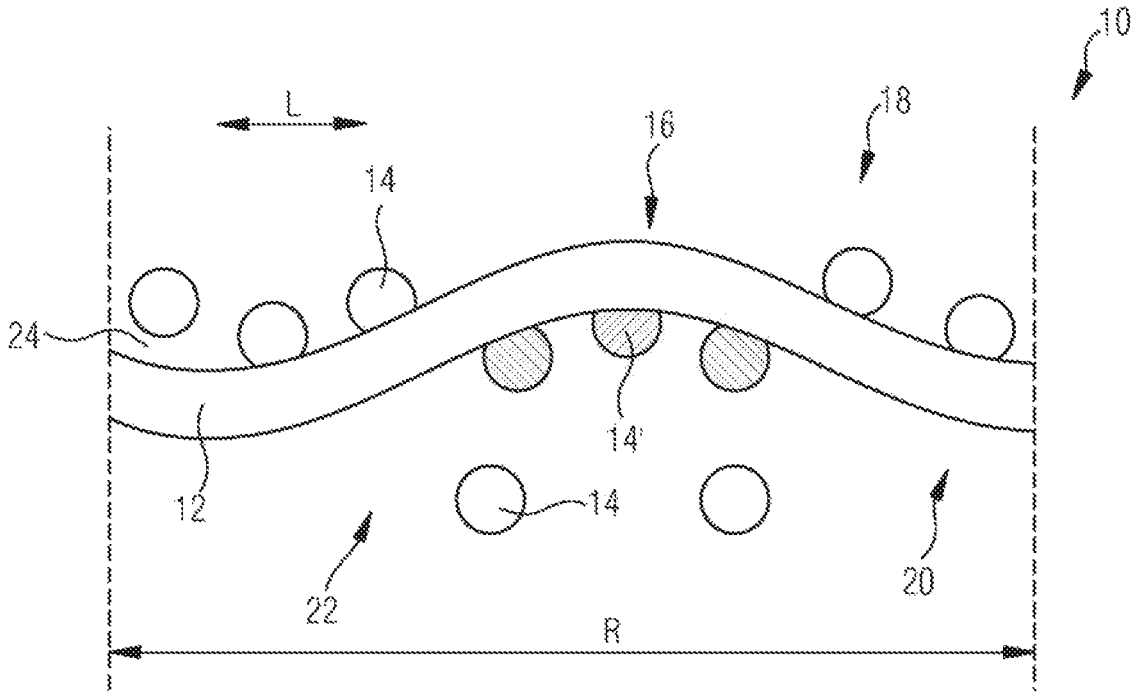
FIG. 1 shows a partial longitudinal section through the woven-fabric structure of a woven-fabric belt for production of spunbonded webs.

The woven-fabric belt 10 is constructed using a plurality of longitudinal threads 12 extending in a longitudinal belt direction L, as provided by warp threads for example, and also transverse threads 14, 14' extending substantially transversely to the longitudinal belt direction L, provided by weft threads for example. The transverse threads include first transverse threads 14 and second transverse threads 14'. The longitudinal threads 12 and the transverse threads 14 interlace and thereby, as is derivable for example from the weave repeat R shown in FIG. 1 for one longitudinal thread 12, give rise to convex longitudinal thread knuckles 16 on a web material contact side 18 and also longitudinal thread knuckles 20 on a machine contact side 22 of the woven-fabric belt 10. It is for example apparent in FIG. 1 that the web material contact side longitudinal thread knuckles 16 extend across three transverse threads 14, 14' to form a crown S1 in the process, while the machine contact side longitudinal thread knuckles 20 extend, for example, across five first transverse threads 14. The result is to create on the web material contact side 18 a comparatively uninterrupted structure, substantially provided by the transverse threads 14 appearing there. On the machine contact side 22, the comparatively long longitudinal thread knuckles 20 present there create a surface which especially in contact with the rolls driving and/or diverting such a woven-fabric belt 10 is very wear-resistant. The knuckles of the transverse threads, i.e., the transverse thread knuckles, cannot be seen in the depiction of FIGS. 1 to 3. Since the longitudinal section plane here is chosen such that it intersects at least some of the first transverse threads 14 at the point where these form a crown S2 for the convex first transverse thread knuckles on the web material contact side 18.

Figure 2:
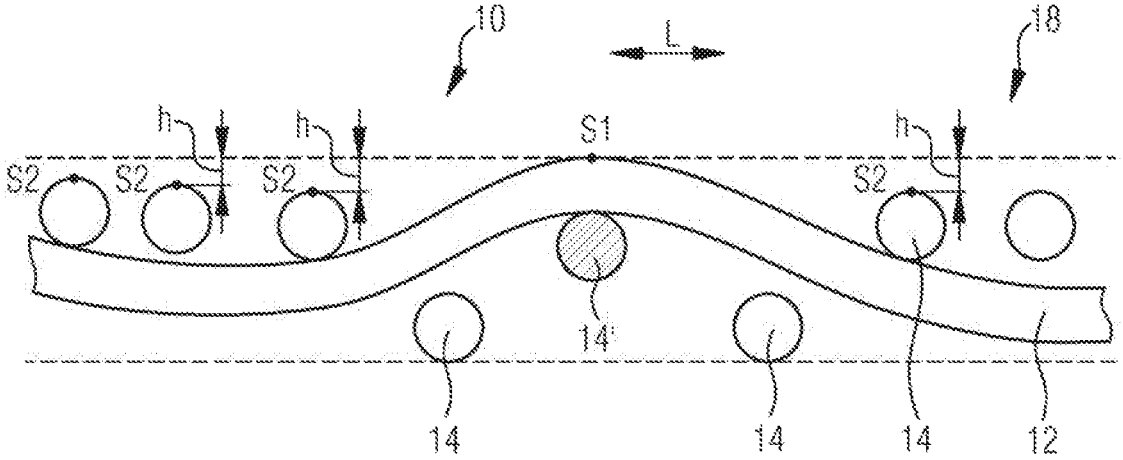
FIG. 2 shows the longitudinal section through the woven-fabric structure of the woven-fabric belt of FIG. 1 with reference-signing of the crowns.

A glance at FIG. 2 reveals the crown S1 of the longitudinal thread 12 and also the crowns S2 of the first transverse threads 14 on the web material contact side 18. According to the present invention, the height difference h between the crowns of at least some of the convex longitudinal thread crowns S1 and the crowns of at least some of the first convex transverse thread knuckles S2 on the web material contact side 18 is less than 220 μm.

Here the first transverse threads 14 of the woven-fabric belt 10 are constructed using a two-phase polymer material. A first one of these polymer material phases may comprise PET material. A second one of these polymer material phases may comprise PE material. The materials of the polymer material phases commix to substantially no extent in the course the production procedure for the first transverse threads 14, for example a melt-spinning process, so regions comprising the material of the first polymer material phase and regions comprising the material of the second polymer material phase will be present in the volume of the first transverse threads 14.

The two polymer material phases are selected such that the polymer materials thereof have different melting temperatures. The melting temperature of the second polymer material phase is below the melting temperature of the first polymer material phase, for example by not less than 30° C.

The longitudinal threads 12 are advantageously likewise constructed using polymer material, preferably using a single phase or a single-phase polymer material which has a melting temperature, that above the melting temperature of the second polymer material phase of the first transverse threads 14. For example, the longitudinal threads 12 may be constructed using the construction material of the first polymer material phase, i.e., PET material for example.

In the production process for such a woven-fabric belt, the weaving process may be followed by a heat-setting procedure at a heat-setting temperature which is below the melting temperature of the construction material of the first polymer material phase, yet above or equal to the melting temperature of the polymer material of the second polymer material phase. This heat-setting procedure, which is generally carried out under tension in the longitudinal belt direction L, i.e., in the direction of longitudinal threads 12, and which may be carried out for example at a heat-setting temperature of 180° C. to 190° C. in the case of the stated materials, leads to some at least partial softening of the polymer material of the second polymer material phase, whereas the polymer material of the first polymer material phase and the polymer material of the longitudinal threads 12 remains substantially unsoftened/unmelted. One result is for the consistency of the first transverse threads 14 in particular to still be retained. Another result is for the softening of the second polymer material phase to work in conjunction with the additionally applied tension in the longitudinal belt direction L to cause the first transverse threads 14 to snug up closer to the longitudinal threads 12. The consequence thereof is an even more perfectly uninterrupted woven-fabric structure where the appearance of voids in the interior thereof is very largely avoided and, what is more, the thickness of the woven-fabric belt 10 decreases. Owing to the superior snugging against each other between the first transverse threads 14 and the longitudinal threads 12, the woven-fabric belt 10 also has an altogether smoother and/or flatter surface, this serving to reduce the appearance of marking effects in the product web material, i.e., spunbonded web for example.

Particularly the spunbonded web production process, being carried out dry, in contradistinction to the papermaking process, and involving the woven-fabric belt 10 moving on the rolls guiding and/or diverting it and a relative movement between the product spunbonded web and the woven-fabric belt 10, gives rise to a risk of electrostatic charges building up. To avoid same, electrically conducting second transverse threads 14' are provided in the woven-fabric belt 10. For instance, one, or at least one, such electrically conducting second transverse thread 14' may be provided per weave repeat R of the longitudinal threads 12. These electrically conducting second transverse threads 14' may, in a side edge region of the woven-fabric belt 10, be in contact with an electric contact at ground potential, so the entire woven-fabric belt 10 is also at ground potential and accordingly electrostatic charges cannot build up.

The electrically conducting second transverse thread 14' may likewise be constructed of polymer material, for example of a single-phase polymer material. The single-phase polymer material of the electrically conducting transverse threads (14') may be for example polyamide (PA) with embedded electrically conducting particles, for example carbon nanotubes.

The electrically conducting second transverse threads 14' may be impregnated into the woven-fabric structure of the woven-fabric belt 10 in the same way as also the electrically non-conducting second transverse threads 14 to achieve for the woven-fabric belt 10 a woven-fabric structure which is independent of this conducting characteristic, for example such a structure as features the floats 16, 20 on the web material contact side 18 and the machine contact side 20, respectively, which are already described above and are also visible in FIG. 1. The benefit achieved through providing this woven-fabric structure and/or the floats, which are shorter on the web material contact side 18 than on the machine contact side 20, is that there is a larger proportion of a combined thread volume due to the longitudinal threads 12 and transverse threads 14, 14' in a volume region closer to the web material contact side 18. For example, a woven-fabric belt thickness region amounting to ¾ of the overall woven-fabric belt thickness on proceeding from the web material contact side 18 may contain a 40 to 50%, preferably 54 to 47%, proportion of a combined thread volume due to the longitudinal threads 12 and the transverse threads 14, 14'. A woven-fabric belt thickness in the region amounting to ¼ of the overall woven-fabric belt thickness on proceeding from the web material contact side 18 may be provided 30 to 45%, preferably 35 to 40%, of the combined thread volume due to the longitudinal threads 12 and the transverse threads 14, 14'. A further benefit achieved through the snugging together of the transverse threads 14, 14' and the longitudinal threads 12 on performing the heat-setting process is that void volume regions 24 covered toward the web material contact side 18 and also to the machine contact side 22 by one thread in each case, i.e., by one longitudinal thread 12 and, respectively, one transverse thread 14, 14', are only present, if at all, in a range from 0 to 4% of the woven-fabric belt overall volume. As a result, there are virtually no regions present in which contaminating particles can enter.

The woven-fabric belt 10 constructed according to the present invention is very useful for producing spunbonded web material. The spinbonding filaments in the production process are applied to the web material contact side 18 in spinbonding filament application regions. Each such spinbonding filament application region may comprise a plurality of successive spinbonding filament extrusion dies in the transverse belt direction, via which the spinbonding filaments produced in an extrusion process are then applied to the web material contact side 18 of the woven-fabric belt 10. Two or more such spinbonding filament application regions may form a consecutive arrangement in the longitudinal belt direction L, so two or more plies of spinbonding filaments are accordingly also depositable on the woven-fabric belt 10 and may subsequently be subjected for example to a calendering process to consolidate the structure of the spunbonded web. Owing to the presence of the electrically conducting second transverse threads 14' in the woven-fabric structure of the woven-fabric belt 10, the build up of electrostatic charges, which might compromise the laydown of the spinbonding filaments on the web material contact side 18 as well as the removal of the spunbonded web from the woven-fabric belt 10, are avoided.

Figure 3:
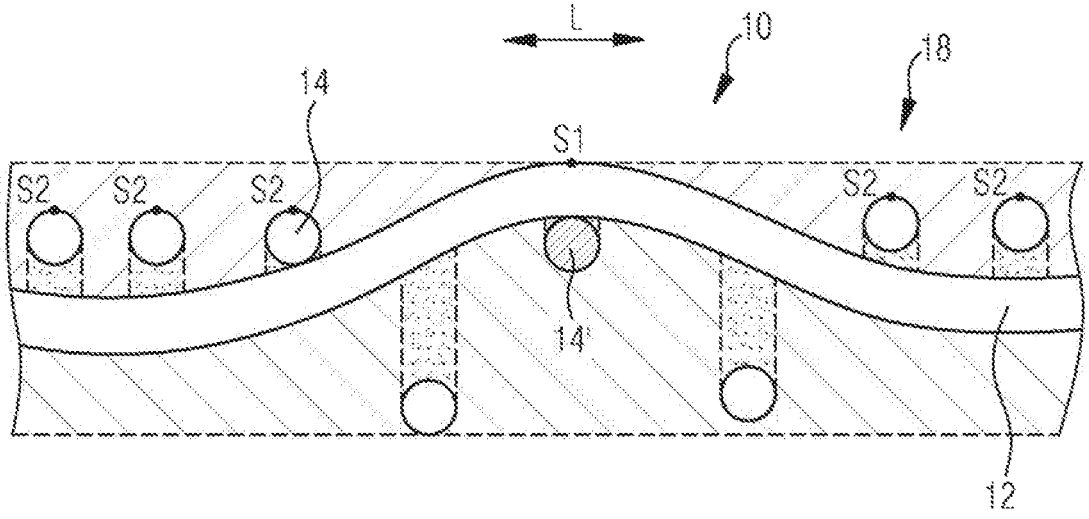
FIG. 3 shows the longitudinal section through the woven-fabric structure of the woven-fabric belt of FIG. 1 with reference-signing of the various void volumes.

FIG. 3 additionally shows the longitudinal section through the woven-fabric structure of the woven-fabric belt 10 of FIG. 1 with reference-signing of the various void volumes.

In FIG. 3, the void volume accessible from the web material contact side 18 is shown by the areas hatched from bottom left to top right. To obtain the void volume, the areas obtained in each longitudinal section plane are integrated. The void volume accessible from the web material contact side 18 may be less than 0.45 $mm^3/mm^2$, preferably 0.40 $mm^3/mm^2$ or less, in an advantageous embodiment of the invention. As is derivable from the depiction of FIG. 3, by the void volume accessible from the web material contact side 18 is meant the void volume which is accessible from the web material contact side in a perpendicular projection.

FIG. 3 further shows the enclosed void volume, i.e., the void volume which is not accessible in perpendicular projection either from the web material contact side or from the machine contact side. The enclosed void volume is depicted by the dotted areas in FIG. 3. A preferred embodiment of the invention provides that the enclosed void volume is less than 0.65 $mm^3/mm^2$, preferably less than 0.60 $mm^3/mm^2$.

The invention claimed is:

1. A woven-fabric belt for forming and transporting spunbonded webs on a web material contact side, the woven-fabric belt comprising:

a plurality of longitudinal threads running substantially in a longitudinal belt direction;

a plurality of transverse threads running substantially in a transverse belt direction and interweaving with said longitudinal threads;

said longitudinal threads and said transverse threads being constructed substantially of a polymer material and a portion of said longitudinal threads and/or said transverse threads including electrically conducting material;

said longitudinal threads forming, on the web material contact side, convex longitudinal thread knuckles having a crown;

said transverse threads including first transverse threads forming, on the web material contact side, convex first transverse thread knuckles having a crown;

wherein a height difference between said crowns of at least some of said convex longitudinal thread knuckles and said crowns of at least some of said first convex transverse thread knuckles on the web material contact side is less than 220 μm; and wherein a material of said first transverse threads is constructed using a two-phase polymer material, wherein a first polymer material phase of the two-phase polymer material has a higher melting temperature than a second polymer material phase of the two-phase polymer material; and wherein said longitudinal threads are constructed using polymer material and the polymer material of said longitudinal threads has a melting temperature above the melting temperature of the second polymer material phase.

2. The woven-fabric belt according to claim 1, wherein a polymer material of said longitudinal threads and of said first transverse threads and for heat-setting the woven-fabric belt are selected such that said first transverse threads are more deformed from a state thereof prior to heat-setting than said longitudinal threads were deformed from a state thereof prior to heat-setting.

3. The woven-fabric belt according to claim 1, wherein the melting temperature of the first polymer material phase of the two-phase polymer material of said first transverse threads and the melting temperature of the polymer material of said longitudinal threads lie above a maximum heat-setting temperature, and the melting temperature of the second polymer material phase of the two-phase polymer material of said first transverse threads is not higher than the maximum heat-setting temperature.

4. The woven-fabric belt according to claim 1, wherein the melting temperature of the second polymer material phase is not less than 30° C. below the melting temperature of the first polymer material phase or/and below the melting temperature of the polymer material of said longitudinal threads.

5. The woven-fabric belt according to claim 1, wherein the electrically conducting said transverse threads are second transverse threads formed of a single-phase polymer material.

6. The woven-fabric belt according to claim 1, wherein the woven-fabric belt, when used in a machine for producing the spunbonded web, is exposed to an operating temperature above room temperature, and wherein the material of said first transverse threads has softened at the operating temperature to thereby increase an adherence of the spunbonded web thereto relative to the adherence at room temperature.

7. The woven-fabric belt according to claim 6, wherein said first transverse threads are formed of a two-phase polymer material and a proportion of first to second polymer material phase of the two-phase polymer material is selected such that said transverse threads constructed of the two-phase polymer material have softened at the operating temperature such that the adherence of the spunbonded web thereto is increased relative to the adherence at room temperature.

8. The woven-fabric belt according to claim 6, wherein, at the operating temperature, the material of said first transverse threads softens to a greater extent that the material of said longitudinal threads, to thereby increase the adherence of the spunbonded web to said first transverse threads to a greater extent than the adherence of the spunbonded web to said longitudinal threads.

9. The woven-fabric belt according to claim 1, wherein a void volume accessible from the web material contact side is less than 0.45 $mm^3/mm^2$.

10. The woven-fabric belt according to claim 1, wherein an enclosed void volume that is accessible neither from the web material contact side nor from a machine contact side of the woven-fabric belt is less than 0.65 $mm^3/mm^2$.

11. The woven-fabric belt according to claim 1, wherein the woven-fabric belt is formed without a void volume connecting the web material contact side to a machine contact side of the woven-fabric belt.

12. A method of producing spunbonded web, the method comprising:

providing a woven-fabric belt according to claim 1;

moving the woven-fabric belt in a belt movement direction and applying spinbonding filaments to a web material contact side of the woven-fabric belt in at least one spinbonding filament application region;

wherein each spinbonding filament application region serves to lay a spunbonded ply down on the woven-fabric belt.

13. The method according to claim 12, which comprises applying the spinbonding filaments in a plurality of spinbonding filament application regions successively in the belt movement direction.

14. The method according to claim 12, wherein each spinbonding filament application region is provided with a multiplicity of spinbonding filament extrusion dies disposed successively in the belt transverse direction, and the method comprises delivering from the spinbonding filament extrusion dies spinbonding filaments onto the web material contact side of the woven-fabric belt.

15. The method according to claim 12, which comprises electrically contacting the woven-fabric belt at a side edge thereof while moving the belt in the belt movement direction.

16. The method according to claim 12, which comprises forming each spunbonded ply with a basis weight of less than 15 grams per $m^2$.

17. The method according to claim 12, which comprises maintaining the woven-fabric belt, at least in the spinbonding filament application region, at an operating temperature above room temperature.

18. The method according to claim 12, which comprises moving the woven-fabric belt in the belt movement direction at a speed of 300 meters per minute or more.

19. The method according to claim 18, which comprises moving the woven-fabric belt at a speed of between 600 and 1100 meters per minute.

20. A woven-fabric belt for forming and transporting spunbonded webs on a web material contact side, the woven-fabric belt comprising:

a plurality of longitudinal threads running substantially in a longitudinal belt direction;

a plurality of transverse threads running substantially in a transverse belt direction and interweaving with said longitudinal threads;

said longitudinal threads and said transverse threads being constructed substantially of a polymer material and a portion of said longitudinal threads and/or said transverse threads including electrically conducting material;

said longitudinal threads forming, on the web material contact side, convex longitudinal thread knuckles having a crown;

said transverse threads including first transverse threads forming, on the web material contact side, convex first transverse thread knuckles having a crown;

said transverse threads including second transverse threads formed of a single-phase polymer material and being electrically conducting transverse threads; and wherein a height difference between said crowns of at least some of said convex longitudinal thread knuckles and said crowns of at least some of said first convex transverse thread knuckles on the web material contact side is less than 220 μm.

* * * * *